US009719315B2

(12) United States Patent
Hughes et al.

(10) Patent No.: US 9,719,315 B2
(45) Date of Patent: Aug. 1, 2017

(54) REMOTE CONTROLLED SELF PROPELLED DEPLOYMENT SYSTEM FOR HORIZONTAL WELLS

(71) Applicant: GE Oil & Gas ESP, Inc., Oklahoma City, OK (US)

(72) Inventors: Michael Franklin Hughes, Oklahoma City, OK (US); Scott Harban, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 451 days.

(21) Appl. No.: 14/081,999

(22) Filed: Nov. 15, 2013

(65) Prior Publication Data

US 2015/0136424 A1 May 21, 2015

(51) Int. Cl.

| | |
|---|---|
| ***E21B 19/22*** | (2006.01) |
| ***E21B 23/10*** | (2006.01) |
| ***E21B 43/12*** | (2006.01) |
| ***E21B 23/14*** | (2006.01) |
| ***E21B 27/00*** | (2006.01) |
| *E21B 23/00* | (2006.01) |

(52) U.S. Cl.

CPC ..... *E21B 19/22* (2013.01); *E21B 23/14* (2013.01); *E21B 27/00* (2013.01); *E21B 43/128* (2013.01); *E21B 2023/008* (2013.01)

(58) Field of Classification Search

CPC ..... E21B 4/04; E21B 19/22; E21B 23/008; B62D 49/00; E21E 23/10

USPC ..... 166/77.2, 77.1

See application file for complete search history.

(56) References Cited

U.S. PATENT DOCUMENTS 4,085,808 A * 4/1978 Kling ..... E21B 4/18 175/61
4,192,380 A * 3/1980 Smith ..... E21B 17/1021 166/104
4,770,105 A * 9/1988 Takagi ..... F16L 55/30 104/138.2

(Continued)

FOREIGN PATENT DOCUMENTS

WO 9812418 A2 3/1998
WO 0140615 A1 6/2001
WO 2005116387 A2 12/2005

OTHER PUBLICATIONS

PCT Search Report and Written Opinion issued in connection with corresponding PCT Application No. PCT/US2014/065707 on Jul. 14, 2015.

(Continued)

*Primary Examiner* — Kenneth L Thompson
(74) *Attorney, Agent, or Firm* — Crowe & Dunlevy, P.C.

(57) ABSTRACT

A self-propelled, remotely-controlled equipment deployment vehicle is configured to deliver equipment to a desired location within the horizontal portion of a deviated wellbore. The deployment vehicle includes a cargo frame, an electric motor and an active mobility assembly. The active mobility assembly is connected to the cargo frame and powered by the electric motor. The cargo frame can be configured to transport, offload and accurately position the selected cargo. Alternatively, the equipment deployment vehicle can be configured with a passive mobility assembly that allows the equipment deployment vehicle to be pushed or pulled along the horizontal section of the wellbore without power.

1 Claim, 6 Drawing Sheets

(56) References Cited

U.S. PATENT DOCUMENTS 4,862,808 A * 9/1989 Hedgcoxe ..... B25J 5/007 104/138.2
4,981,080 A * 1/1991 Elstone, III ..... B61B 13/10 104/138.2
5,375,668 A * 12/1994 Hallundbaek ..... E21B 4/02 175/19
5,565,633 A * 10/1996 Wernicke ..... G01N 27/82 324/220
6,257,332 B1 * 7/2001 Vidrine ..... E21B 43/12 166/250.15
6,273,189 B1 * 8/2001 Gissler ..... E21B 4/04 166/241.1
6,467,557 B1 10/2002 Krueger et al.
6,557,642 B2 * 5/2003 Head ..... E21B 17/003 166/381
6,761,233 B1 * 7/2004 Aadland ..... F16L 55/30 166/217
6,857,486 B2 * 2/2005 Chitwood ..... E21B 4/04 114/312
7,143,843 B2 * 12/2006 Doering ..... E21B 4/18 175/24
7,188,568 B2 * 3/2007 Stout ..... F16L 55/32 104/138.2
7,325,606 B1 * 2/2008 Vail, III ..... E21B 43/128 166/250.15
7,685,946 B1 * 3/2010 Elstone, III ..... B09B 1/006 104/138.1
8,272,447 B2 * 9/2012 Lee ..... E21B 43/305 166/242.6
8,390,278 B2 * 3/2013 Petrosky ..... G01N 27/90 324/220
8,770,271 B2 * 7/2014 Fielder ..... E21B 43/128 166/66.4
8,844,636 B2 * 9/2014 Bebak ..... E21B 23/08 166/381
9,062,503 B2 * 6/2015 Lehr ..... E21B 7/068
9,133,673 B2 * 9/2015 Hill ..... E21B 4/18
9,494,029 B2 * 11/2016 Hughes ..... E21B 43/128
2001/0050173 A1 12/2001 Head
2004/0108110 A1 6/2004 Zupanick
2005/0217861 A1 * 10/2005 Misselbrook ..... E21B 17/20 166/373
2006/0042835 A1 * 3/2006 Guerrero ..... E21B 7/06 175/61
2009/0084543 A1 4/2009 Fitzgerald
2009/0091278 A1 4/2009 Montois et al.
2009/0145595 A1 6/2009 Mazzanti
2009/0271117 A1 10/2009 Ayoub
2009/0277628 A1 11/2009 Watson
2010/0139388 A1 6/2010 Griffiths
2010/0263856 A1 10/2010 Lynde
2010/0288493 A1 * 11/2010 Fielder ..... F04B 47/02 166/250.15
2010/0288501 A1 * 11/2010 Fielder ..... E21B 43/128 166/311
2010/0314103 A1 12/2010 Crossley
2011/0051297 A1 3/2011 Knox
2011/0278015 A1 11/2011 Mazzanti
2012/0012333 A1 1/2012 Quigley
2012/0145380 A1 6/2012 Draper et al.
2013/0025852 A1 1/2013 Edmonstone
2013/0333970 A1 * 12/2013 Heieie ..... E21B 7/046 180/167
2014/0341755 A1 11/2014 Laing

OTHER PUBLICATIONS

Invitation to Pay Additional Fees issued in connection with corresponding PCT Application No. PCT/US2014/065707 dated May 12, 2015.

* cited by examiner

REMOTE CONTROLLED SELF PROPELLED DEPLOYMENT SYSTEM FOR HORIZONTAL WELLS

FIELD OF THE INVENTION

This invention relates generally to the field of downhole pumping systems, and more particularly to a deployment system for use in horizontal and deviated wellbores.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface.

With advancements in drilling technology, it is now possible to accurately drill wells with multiple horizontal deviations. Horizontal wells are particularly prevalent in unconventional shale plays, where vertical depths may range up to about 10,000 feet with lateral sections extending up to another 10,000 feet with multiple undulations.

Current methods of inserting equipment and tools into lateral portions of a wellbore have had limited success. Coil tubing systems have been used but are limited by the extent to which these systems are capable of pushing equipment deep into the laterals. There is, therefore, a continued need for an improved deployment system that is capable of delivering equipment through the lateral sections of deviated wellbores. It is to these and other deficiencies in the prior art that the present invention is directed.

SUMMARY OF THE INVENTION

In a first preferred embodiment, the present invention includes a self-propelled, remotely-controlled equipment deployment vehicle. The equipment deployment vehicle includes a cargo frame, an electric motor and an active mobility assembly. The active mobility assembly is connected to the cargo frame and powered by the electric motor. The cargo frame can be configured to transport, offload and accurately position the selected cargo.

In a second preferred embodiment, the present invention includes a passive equipment deployment vehicle. The passive equipment deployment vehicle includes at least a cargo frame and a passive mobility assembly. The passive mobility assembly facilitates the movement of the cargo frame within the wellbore. The cargo frame can be configured to transport, offload and accurately position the selected cargo.

In a third preferred embodiment, the present invention includes an equipment deployment system that includes a combination of at least one self-propelled, remotely controlled vehicle and at least one passive equipment deployment vehicle.

DETAILED DESCRIPTION OF THE PREFERRED EMBODIMENT

For the purposes of the disclosure herein, the terms "upstream" and "downstream" shall be used to refer to the relative positions of components or portions of components with respect to the general flow of fluids produced from the wellbore. "Upstream" refers to a position or component that is passed earlier than a "downstream" position or component as fluid is produced from the wellbore. The terms "upstream" and "downstream" are not necessarily dependent on the relative vertical orientation of a component or position. It will be appreciated that many of the components in the following description are substantially cylindrical and have a common longitudinal axis that extends through the center of the elongated cylinder and a radius extending from the longitudinal axis to an outer circumference. Objects and motion may be described in terms of radial positions.

Figure 1:
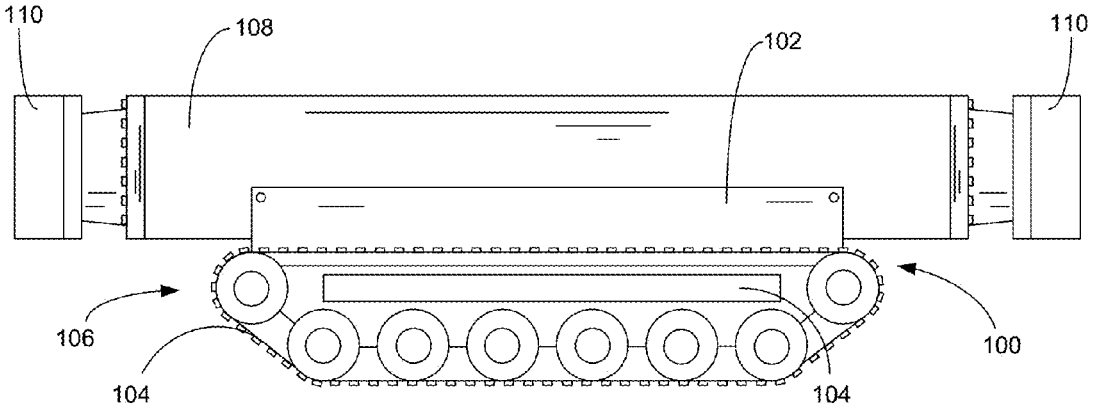
FIG. 1 is a side view of an equipment deployment vehicle constructed in accordance with a first preferred embodiment.
Figure 2:
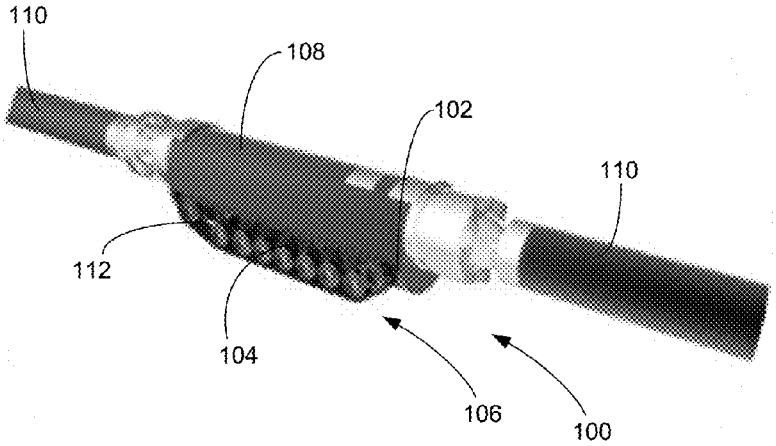
FIG. 2 is a perspective view of the equipment deployment vehicle of FIG. 1.

In accordance with a preferred embodiment of the present invention, FIGS. 1 and 2 present side and perspective views, respectively, of an equipment deployment vehicle 100 constructed in accordance with a first preferred embodiment. The equipment deployment vehicle 100 is generally configured and designed to deliver, deploy or position tools and other equipment within a deviated wellbore. The use of the equipment deployment vehicle 100 presents a significant advance over prior art efforts to position equipment within deviated wellbores.

The equipment deployment vehicle 100 preferably includes a cargo frame 102, an electric motor 104 and a mobility assembly 106. In the first preferred embodiment depicted in FIG. 1, the equipment deployment vehicle 100 is shown with cargo 108 present within the cargo frame 102. The cargo frame 102 is preferably sized and configured to securely support the cargo 108. The cargo 108 may include any tool, equipment or other cargo that is intended to be deployed or positioned downhole, such as, for example, electric submersible pumping units, tubing, tubing connectors, tubing adaptors, sensor packages, gas separators, perforating tools, and injection pumps. The weight of the cargo 108 holds the mobility assembly 106 to the surface of the wellbore. The relatively small diameter of the wellbore encourages an arc of tight contact between the wellbore and the articulated surfaces of the mobility assembly 106.

In the perspective depiction in FIG. 2, the tool 108 is shown connected to tubing 110. All of the components of the equipment deployment vehicle 100 are constructed from steel, high-temperature polymers or other materials that are capable of withstanding the elevated temperatures, significant pressures and corrosive fluids found in the wellbore. The mobility assembly 106 can be configured to move and change the direction of movement of the equipment deployment vehicle 100.

In the first preferred embodiment, the equipment deployment vehicle 100 is configured as a self-propelled, remote-controlled vehicle that includes an "active" mobility assembly 106. The active mobility assembly 106 includes a pair of endless tracks 112 that are controllably driven by the electric motor 104. The tracks 112 preferably include an aggressively treaded exterior surface for efficiently moving the equipment deployment vehicle 100 along the deviated wellbore.

In a variation of the first preferred embodiment, the active mobility assembly 106 is replaced with a passive mobility assembly in which the tracks 112 are not driven by the electric motor 104. The use of the passive mobility assembly may be desirable in situations in which the equipment deployment vehicle 100 is connected to and moved by a second equipment deployment vehicle 100.

Figure 3:
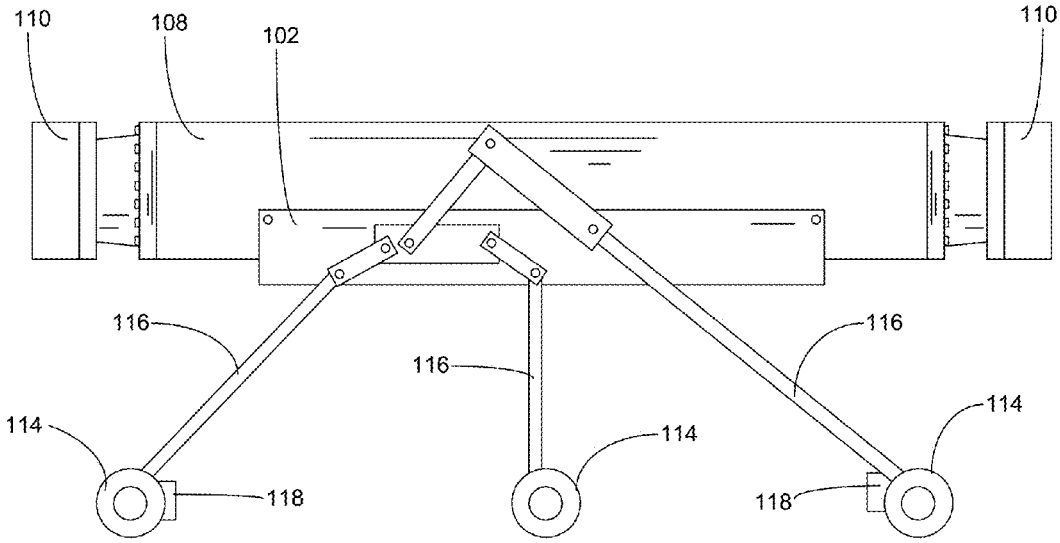
FIG. 3 is a side view of an equipment deployment vehicle constructed in accordance with a second preferred embodiment.
Figure 4:
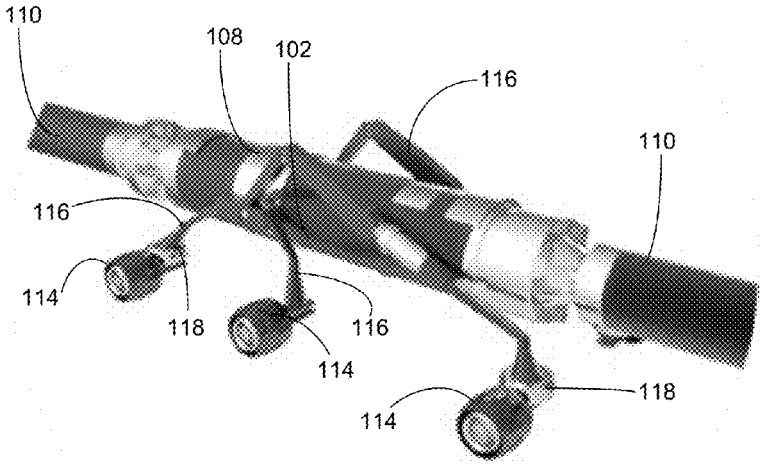
FIG. 4 is a perspective view of the equipment deployment vehicle of FIG. 3.

Turning to FIGS. 3 and 4, shown therein are side and perspective views, respectively, of the equipment deployment vehicle 100 constructed in accordance with a second preferred embodiment. In the second preferred embodiment, the mobility assembly 106 includes a series of wheels 114 connected to articulating legs 116. The mobility assembly 106 further includes a series of independent motors 118 positioned near one or more of the wheels 114. In the highly preferred embodiment depicted in FIG. 4, the independent motors 118 and wheels 114 are pivotally connected to the articulating legs 116. The independent motors 118 are configured to drive the wheels 114 without the need for an intermediate transmission. The articulating legs 116 are configured to extend, contract and pivot to provide a suspension system that permits the movement of the equipment deployment vehicle 100 over large obstacles.

Figure 5:
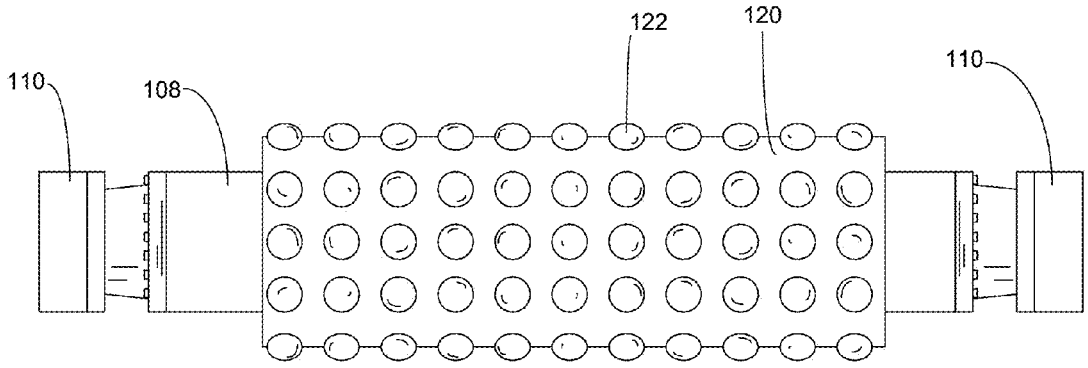
FIG. 5 is a side view of an equipment deployment vehicle constructed in accordance with a third preferred embodiment.
Figure 6:
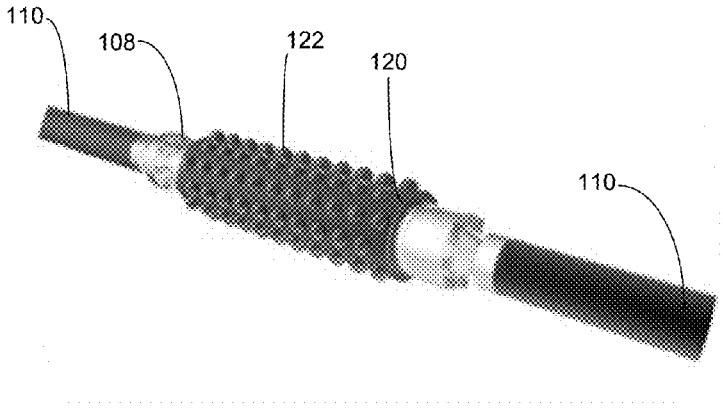
FIG. 6 is a perspective view of the equipment deployment vehicle of FIG. 5.

Turning to FIGS. 5 and 6, shown therein are side and perspective views, respectively, of a third preferred embodiment of the equipment deployment vehicle 100. In the third preferred embodiment, the mobility assembly 106 of the equipment deployment vehicle 100 is configured as a cylindrical sleeve 120 that surrounds the cargo frame 102. The sleeve 120 includes a plurality of ball bearings 122 that extend through the sleeve 120. In a particularly preferred variation of the third preferred embodiment, the ball bearings 122 and sleeve 120 constitute a passive mobility assembly 106 that allows the cargo 108 to be pulled or pushed along the wellbore. The ball bearings 122 provide a low-friction mechanism for supporting and moving the cargo 108. Additionally, the cylindrical sleeve 120 and ball bearings 122 can be configured such that the equipment deployment vehicle 100 functions as a mobile centralizer to position the cargo 108 within the center of the wellbore.

Figure 7:
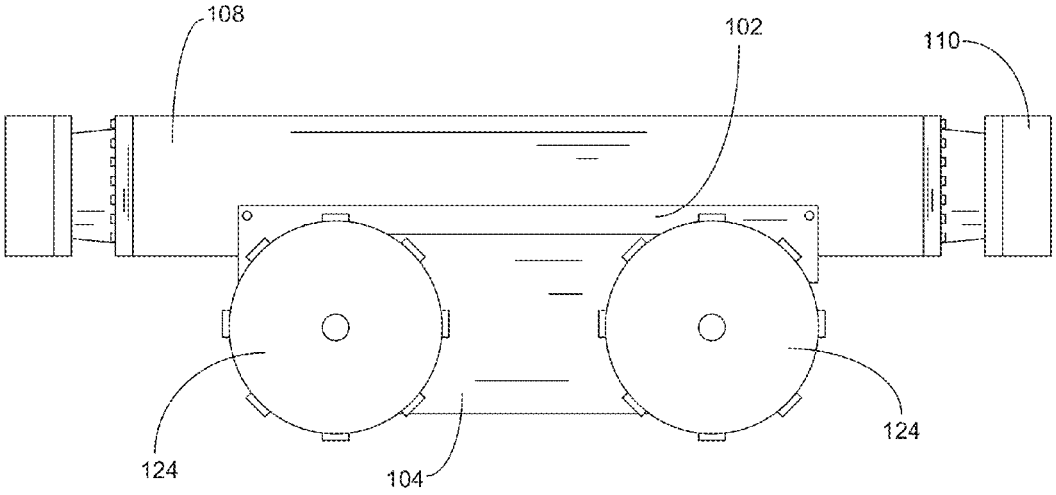
FIG. 7 is a side view of an equipment deployment vehicle constructed in accordance with a fourth preferred embodiment.

Turning to FIG. 7, shown therein is a side view of a fourth preferred embodiment in which the mobility assembly 106 includes four aggressively treaded wheels 124 connected to the electric motor 104. The treaded wheels 124 can be selectively controlled to drive and maneuver the equipment deployment vehicle 100 within the wellbore.

Figure 8:
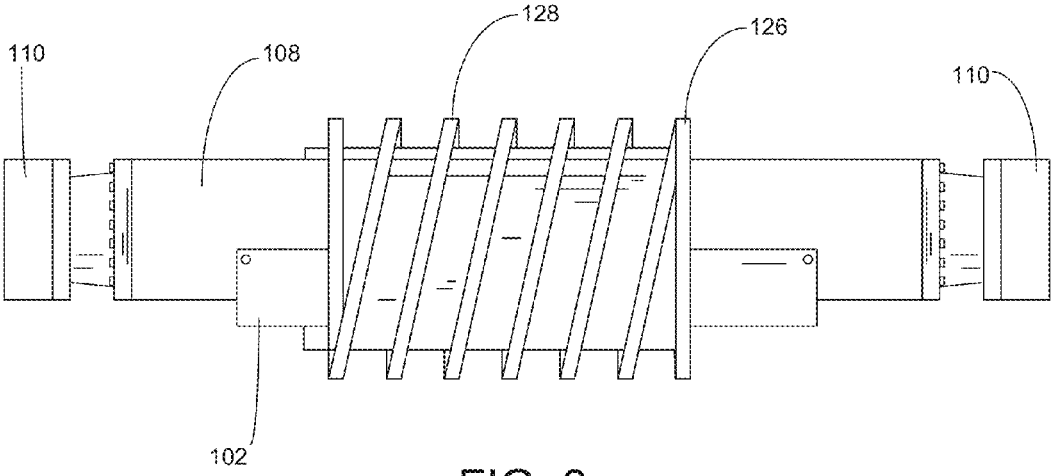
FIG. 8 is a side view of an equipment deployment vehicle constructed in accordance with a fifth preferred embodiment.

Turning to FIG. 8, shown therein is a side view of a fifth preferred embodiment in which the mobility assembly 106 includes a rotary auger 126 that pulls the equipment deployment vehicle 100 along the wellbore. The rotary auger 126 includes one or more continuous spiraled flights 128. The continuous spiraled flights 128 provide a slow, incremental movement. In a particularly preferred embodiment, the rotary auger 126 is constructed from a low durometer polymer. The use of the rotary auger 126 is particularly useful in non-cased wells in which the wellbore is an "open-hole" that includes exposed rock.

Figure 9:
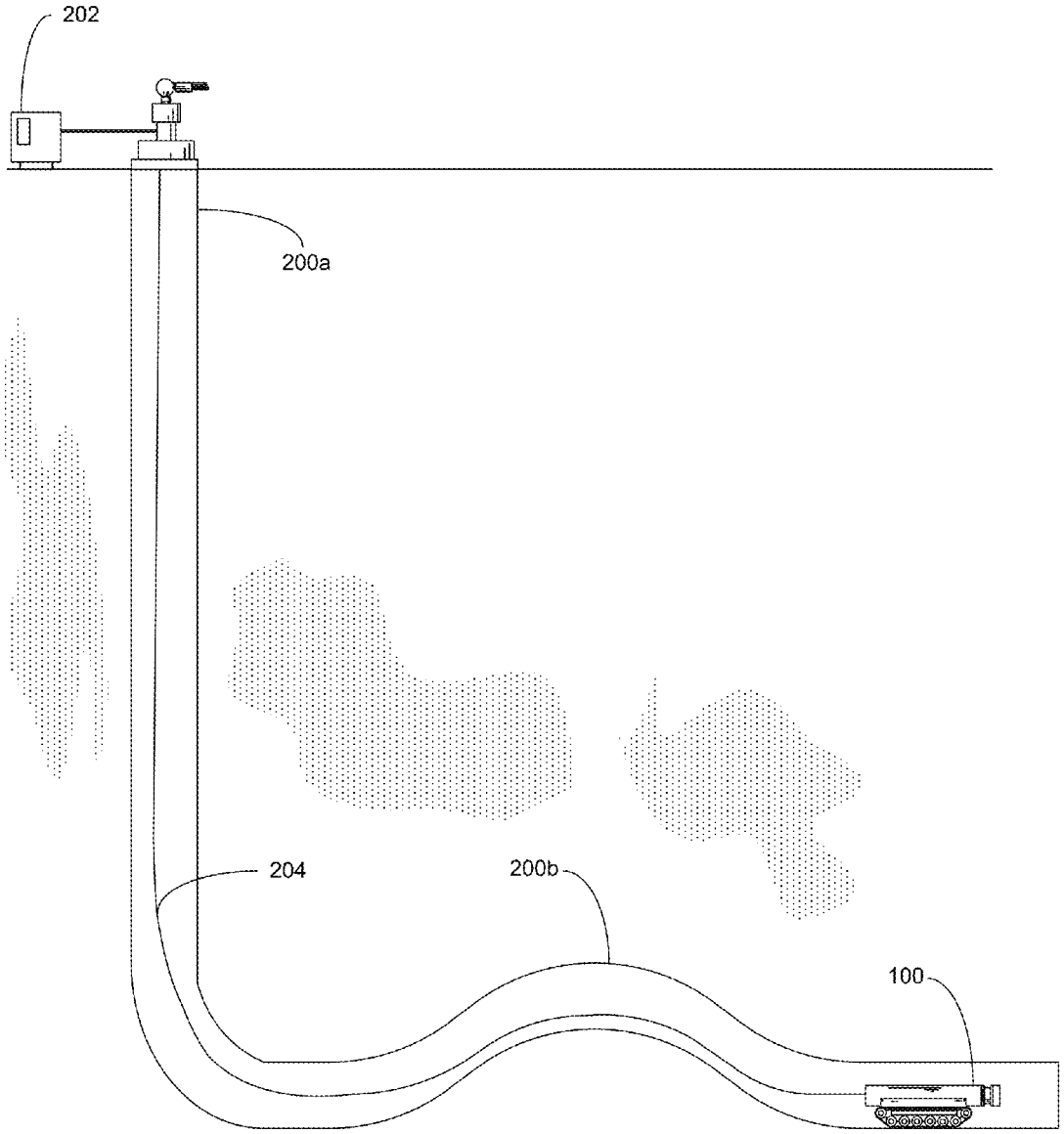
FIG. 9 is a depiction of a deviated wellbore and an equipment deployment vehicle constructed in accordance with a preferred embodiment.

Referring now to FIG. 9, shown therein is a depiction of the equipment deployment vehicle 100 positioned within a wellbore 200. The wellbore 200 includes a vertical section 200*a* and a horizontal section 200*b*. The equipment deployment vehicle 100 has been deployed from the surface through the vertical section 200*a* and has driven under its own power through the horizontal section 200*b*. The equipment deployment vehicle 100 is connected to surface-based control systems 202 with an umbilical 204. It will be understood that the umbilical 204 carries power, telemetry and signal data between the equipment deployment vehicle 100 and the surface-based control systems 202. The umbilical 204 can also be used to retrieve the equipment deployment vehicle 100 through the wellbore 200. Although the umbilical is well-suited to carry information from the equipment deployment vehicle 100, it will be appreciated that the equipment deployment vehicle 100 may also include wireless transmitters and receivers that are configured to communicate wirelessly with the surface-based control systems 202, satellites or wireless radio networks.

Figure 10:
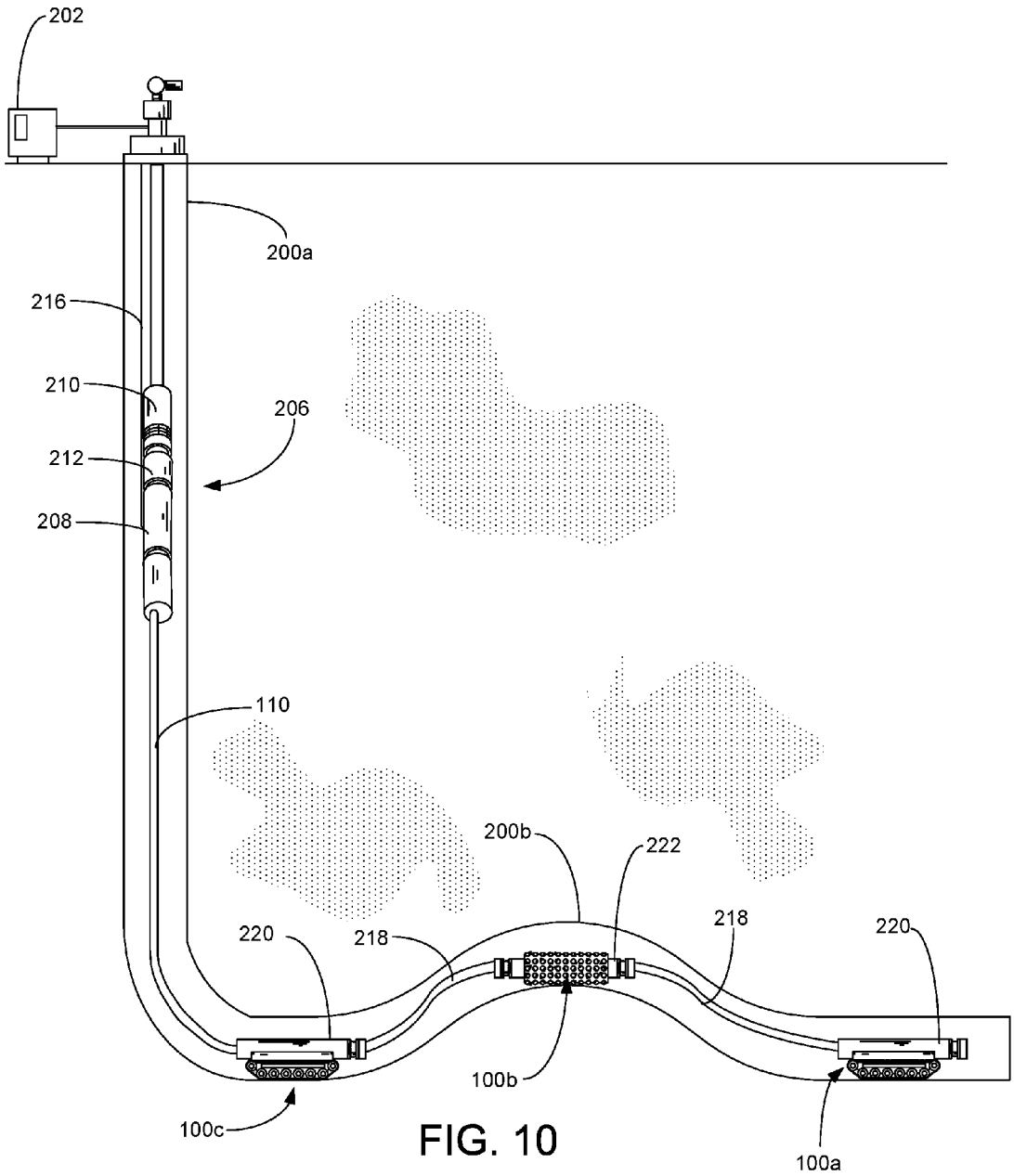
FIG. 10 is a depiction of a deviated wellbore and a pair or trained equipment deployment vehicles constructed in accordance with a preferred embodiment.

Turning to FIG. 10, depicted therein are three equipment deployment vehicles 100*a*, 100*b* and 100*c* deployed within the horizontal section 200*b* of the wellbore 200. In addition to the three equipment deployment vehicles 100, an electric submersible pumping system 206 is also disposed within the vertical section 200*a* of the wellbore 200. The electric submersible pumping system 206 generally includes a motor 208, a pump 210 and a seal section 212 disposed between the motor 208 and the pump 210. When energized with electric power from the surface, the motor 208 drives the pump 210, which pushes wellbore fluids to the surface through production tubing 214. Power and communication signals are provided to the electric submersible pumping system 206 from the surface-based control systems 202 through a power cable 216.

The three equipment deployment vehicles 100*a*, 100*b* and 100*c* are connected to each other and to the electric submersible pumping system 206 by high-pressure flexible conduits 218. The three equipment deployment vehicles 100*a*, 100*b* and 100*c* are connected to the surface-based controls 202 through the electric submersible pumping system 206. The umbilical 204 may be attached to the outside of the flexible conduits 218 or housed on the inside of the flexible conduits 218.

As a non-limiting example of the types of cargo 108 carried by the equipment deployment vehicles 100, the equipment deployment vehicle 100*a* and equipment deployment vehicle 100*c* are each provided with a sensor module 220 that measure wellbore conditions (e.g., temperature, pressure and fluid composition) and output electric signals representative of these measurements. The equipment deployment vehicle 100*b* includes a conduit connector 222 that connects the flexible conduits 218 extending between the equipment deployment vehicle 100*a* and equipment deployment vehicle 100*c*.

It will be further noted that equipment deployment vehicle 100*a* and equipment deployment vehicle 100*c* are provided with active mobility assemblies 106 in the form of powered endless tracks 112. The intermediate equipment deployment vehicle 100*b* is configured with a passive mobility assembly 106 that includes the cylindrical sleeve 120 with free-spinning ball bearings 122. In this way, the equipment deployment vehicles 100*a*, 100*c* pull and push, respectively, the intermediate equipment deployment vehicle 100*b*.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method of deploying a piece of equipment to a desired location in a horizontal section of a deviated wellbore that also includes a vertical section, the method comprising the steps of:

providing an electric submersible pumping system in the vertical section of the wellbore;

providing an equipment deployment vehicle that includes a cargo frame;

securing the piece of equipment to the cargo frame;

connecting an umbilical from the electric submersible pumping system to the equipment deployment vehicle;

placing the equipment deployment vehicle into the wellbore;

lowering the equipment deployment vehicle through a vertical section of the wellbore;

landing the equipment deployment vehicle on the horizontal section of the deviated wellbore; and driving the equipment deployment vehicle through the horizontal section of the deviated wellbore to the desired location, wherein the step of driving the equipment deployment vehicle further comprises controllably activating a plurality of independent motors to rotate a plurality of wheels mounted on articulating legs.

* * * * *